US007400305B2

(12) United States Patent
Shigemoto

(10) Patent No.: US 7,400,305 B2
(45) Date of Patent: Jul. 15, 2008

(54) WATERPROOF ANTENNA DEVICE

(75) Inventor: Hideki Shigemoto, Okaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/612,086

(22) Filed: Dec. 18, 2006

(65) Prior Publication Data

US 2007/0139288 A1 Jun. 21, 2007

(30) Foreign Application Priority Data

Dec. 21, 2005 (JP) ..... 2005-367700

(51) Int. Cl.
*H01Q 1/42* (2006.01)
*H01Q 1/36* (2006.01)

(52) U.S. Cl. ..... 343/895; 343/872

(58) Field of Classification Search ..... 343/872, 343/895, 788, 711, 713, 702, 715
See application file for complete search history.

(56) References Cited

U.S. PATENT DOCUMENTS

| | | | | |
|---|---|---|---|---|
| 6,262,693 | B1 * | 7/2001 | Sutter et al. | 343/895 |
| 6,661,391 | B2 * | 12/2003 | Ohara et al. | 343/895 |
| 6,690,335 | B2 * | 2/2004 | Onishi et al. | 343/872 |
| 7,195,520 | B1 * | 3/2007 | Huang | 439/638 |
| 7,262,745 | B2 * | 8/2007 | Noro et al. | 343/895 |

FOREIGN PATENT DOCUMENTS

JP 2001-345615 12/2001

* cited by examiner

*Primary Examiner*—Tan Ho
(74) *Attorney, Agent, or Firm*—RatnerPrestia

(57) ABSTRACT

An antenna device having a substantially cylindrical shaped case to house the antenna part and a stopper to seal a case opening tightly, wherein the stopper has the first waterproof on the outer periphery to contact the case and the second waterproof on the inner periphery to contact the lead wires. The first waterproof and the second waterproof are disposed on a same location. The present invention can provide the antenna device capable of preventing water immersion into the case simply and reliably without using any filler.

7 Claims, 5 Drawing Sheets

WATERPROOF ANTENNA DEVICE

FIELD OF THE INVENTION

The present invention relates to an antenna device for use in a remote-control system to control locking/unlocking vehicle doors or the like from a distance through a radio communication using a mobile device.

BACKGROUND ART

In recent years, a remote-control system has being widely used to control locking/unlocking vehicle doors from a distance by communicating between a mobile device and an antenna device installed in the vehicle.

The conventional antenna device for use in such a remote-control system is described with reference to FIG. 6. FIG. 6 shows a cross-sectional view of conventional antenna device 10. Substantially box-like case 1 formed from a non-conducting material has opening 1A in the top surface, and extended terminals 2A and 2B are embedded in the left hand side of case 1 as shown in FIG. 6. Extended terminals 2A and 2B are molded integrally with case 1.

Case 1 includes antenna part 3. Antenna part 3 includes: ferrite core 3A; coil 3B wound on the outer periphery of ferrite core 3A; and capacitor 3C connected in series with coil 3B. The winding start of coil 3B is connected to extended terminal 2A and the winding end of coil 3B is connected to an end of capacitor 3C. The other end of capacitor 3C is connected to extended terminal 2B.

Extended terminals 2A and 2B are respectively connected to lead wire 5 outside case 1. The joints of extended terminals 2A and 2B to lead wire 5 are respectively covered by heat shrinkable tube 9 to prevent external exposure and the other end of lead wire 5 is connected to an in-vehicle unit (not shown) installed in a vehicle via a junction connector (not shown).

Antenna part 3 is sealed into case 1 using filler 6 such as silicon resin or epoxy resin. Filler 6 filled into case 1 is cured at a predetermined temperature to secure antenna part 3 inside case 1.

Lid 4 has locking holes 4A on both sides. Hooks 1B engage with locking holes 4A to cover opening 1A of case 1 by lid 4.

The operation of antenna device 10 is described next.

Antenna device 10 with above configuration is installed for instance inside a vehicle door handle. When a user who has a mobile device approaches the vehicle, the mobile device receives signal waves from antenna device 10. The mobile device decodes the signal waves received and transmittes a responding signal to antenna device 10. The in-vehicle unit installed in the vehicle decodes the responding signal received by antenna device 10 and controls locking/unlocking of the vehicle doors. The user can thus control locking/unlocking the vehicle doors by only carrying the mobile devic.

For example, Japanese Patent Unexamined Application No. 2001-345615 discloses such a conventional art.

However, since the conventional antenna device 10 is housed inside a door handle or the like and is therefore apt to getting wet by raindrops or water drops in vehicle washing, the waterproofing is necessary for antenna part 3 in antenna device 10. After antenna part 3 is housed, therefore, case 1 is filled with filler 6 and is then cured to secure antenna part 3 inside case 1.

However, merely filling and curing filler 6 is not sufficient to obtain good water proofing performance. Filler 6 must be kept under an atmosphere of reduced pressure such as vacuum or the like to release air trapped in filler 6 during the filling process before filler 6 is cured so as not to form residual bubbles. As described above, conventional antenna device 10 needs a long time and complicated processes for production.

SUMMARY OF THE INVENTION

The antenna device disclosed in the present invention comprises: the first waterproof provided on the outer periphery of a stopper which is to seal the case opening tightly; and the second waterproof provided on the inner periphery of the stopper, wherein the first waterproof and the second waterproof are disposed on locations approximately the same distance from the top surface of the stopper. Since the first and second waterproofs can prevent water immersion into the case from outside, and therefore the filler that has been needed previously is no longer required, the invention can provide an antenna device with a simplified manufacturing process.

Additional objects and advantages of the present invention will be apparent from the following detailed description of the exemplary embodiments, which are best understood with reference to the accompanying drawings.

DETAILED DESCRIPTION OF THE INVENTION

The exemplary embodiments of the present invention are described with reference to FIGS. 1 to 5.

EXEMPLARY EMBODIMENTS

Figure 1:
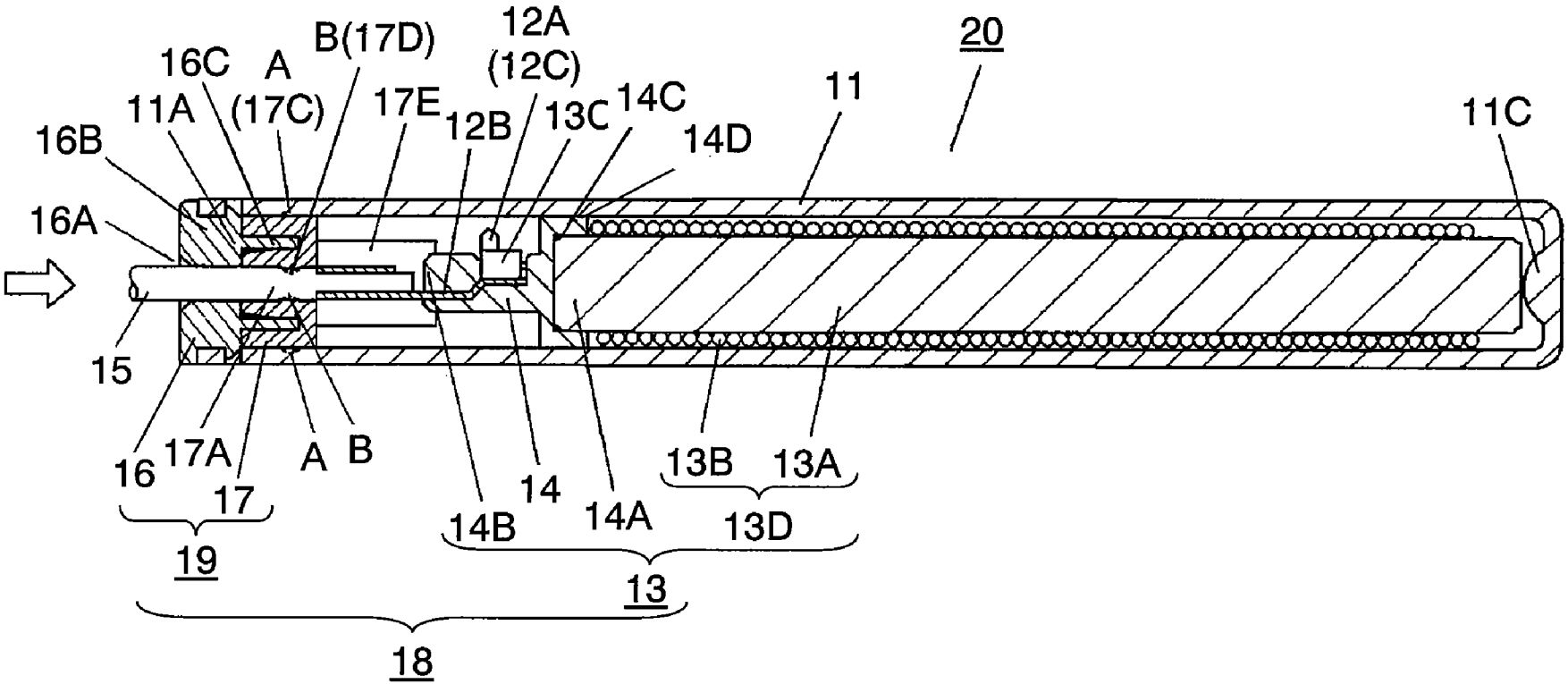
FIG. 1 shows a cross-sectional view of the antenna device used in the exemplary embodiment of the present invention.
Figures 2A, 2B:
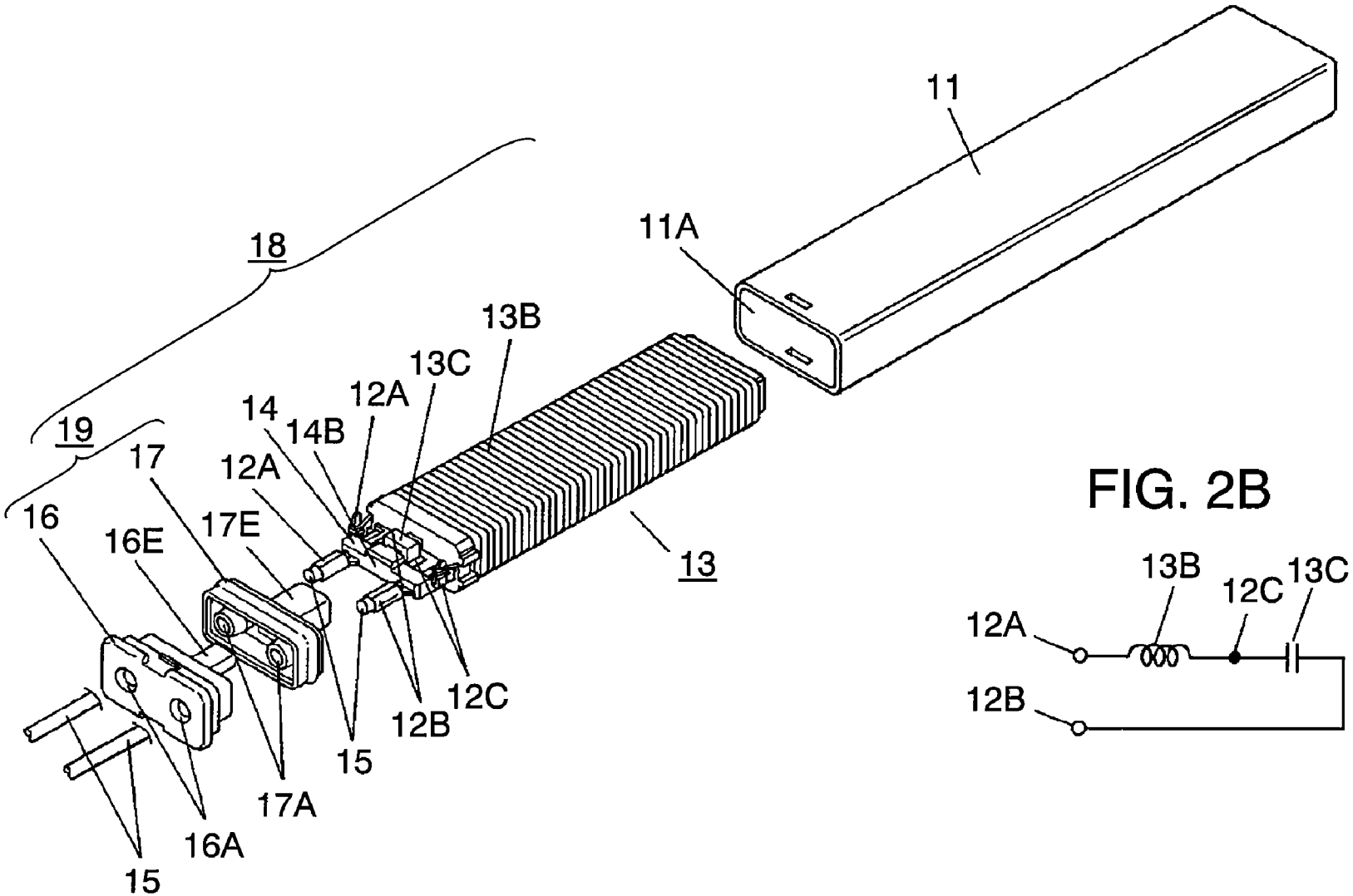
FIG. 2A shows an exploded perspective view of the antenna device used in the exemplary embodiment of the present invention.
FIG. 2B shows a circuit diagram of the antenna device used in the exemplary embodiment of the present invention.
Figure 3A:
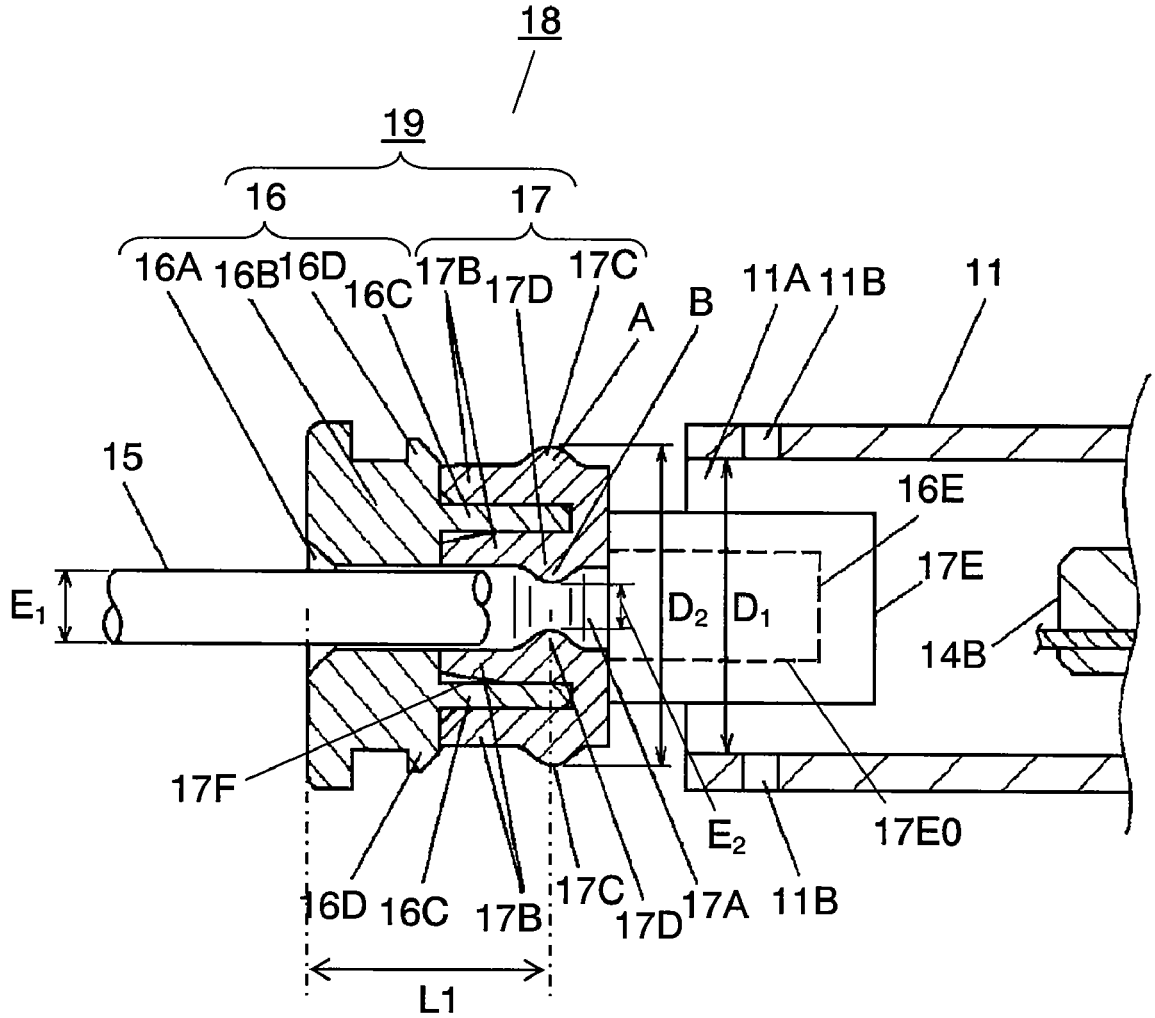
FIG. 3A shows an enlarged cross-sectional view of an essential part of the antenna device used in the exemplary embodiment of the present invention.
Figure 3B:
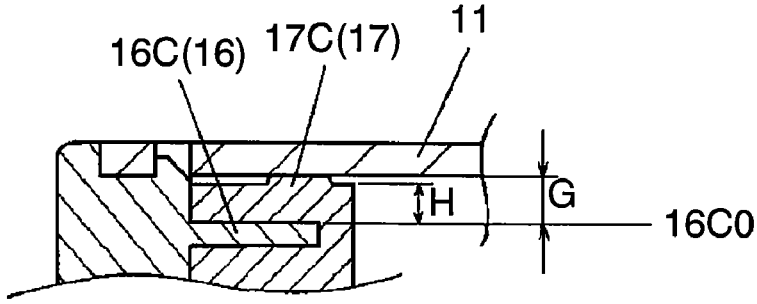
FIG. 3B shows an enlarged cross-sectional view of an essential part of the antenna device used in the exemplary embodiment of the present invention.

FIGS. 1 to 3 illustrate an antenna device used in the exemplary embodiments of the present invention. FIG. 1 shows a cross-sectional view of antenna device 20, FIG. 2A shows an exploded perspective view of antenna device 20, and FIGS. 3A and 3B show enlarged cross-sectional views of essential parts of antenna device 20.

Substantially cylindrical shaped case 11 is formed from materials having good properties in heat resistance and mechanical strength such as polybutylene terephthalate (PBT) or the like. Antenna part 13 is housed into case 11 through opening 11A formed on the left hand side of case 11.

Antenna part 13 includes: ferrite core 13A or a magnetic material, coil 13B wound around the outer periphery of ferrite core 13A, and capacitor 13C connected in series with coil 13B.

The integration of ferrite core 13A and coil 13B is named as core section 13D. An end of core section 13D is press-fitted into opening 14A provided on terminal base 14. Terminal base 14 is formed from a heat resistant resin, and internal terminals 12A, 12B and 12C are integrated with terminal base 14 by insert molding. Typical engineering plastics can be used as the heat resistant resin.

A plurality of ribs or string-like projections directing to the opening are provided on inner surface 14C and outer surface 14D of opening 14A of terminal base 14. Upon pressing to fit into opening 14A, core section 13D is pressed into opening 14A while deforming the ribs. Among the heat resistant resins, therefore, a resin with such a hardness of the order that the rib will be deformed in pressed fitting for instance liquid crystal polymer or the like would be preferable. Moreover, following resins can also be used: Polyphenylenesulfide (PPS), Polyamide (PA), Polyethersulfone (PES), Polyetherimide (PEI) and Polyetheretherketone (PEEK).

The winding start of coil 13B is connected to internal terminal 12A and the winding end to internal terminal 12C as shown in FIGS. 2A and 2B. Additionally, an end of capacitor 13C is connected to an electrode formed extended from internal terminal 12C by soldering or the like. The other end of capacitor 13C is connected to an electrode formed extended from internal terminal 12B by soldering or the like.

Respective ends of lead wires 15 are connected to internal terminals 12A and 12B by soldering, crimping or welding. Lead wires 15 extends outward through through-holes 17A of packing 17 and further through-holes 16A provided on lid 16. The other ends of lead wires 15 are connected to an in-vehicle unit (not shown) installed in a vehicle via a junction connector (not shown).

Lid 16 for sealing opening 11A of case 11 tightly is formed from similar materials to case 11 which have good properties in heat resistance and mechanical strength. Packing 17 should preferably be formed from elastic materials. Materials with good elasticity such as rubber, elastomer and thermoplastic elastomer should be preferable. Rubbers such as silicon rubber, fluorocarbon rubber and ethylene-propylene rubber or the like can be used. Thermoplastic elastomers such as polyester elastomer, polyurethane elastomer or the like can also be used.

An integration of lid 16 fitted with packing 17 is named as stopper 19. Lid 16 includes base 16B and annular projection 16C formed extending substantially perpendicularly to the right direction from base 16 as shown in FIG. 1. Annular taper 17F formed on packing 17 fits annular projection 16C to form an integration with lid 16. Packing 17 has a substantially semicircular first protrusion 17C provided annularly on the outer periphery of case 11 in the side of opening 11A, and additionally has a substantially semicircular second protrusion 17D provided annularly on the side of through-hole 17A, or the side of inner periphery, of packing 17. first protrusion 17C and second protrusion 17D are formed in entire circumference.

The integration of stopper 19, lead wires 15 and antenna part 13 is named as housed body 18. Housed body 18 is housed into case 11 from the left hand side as indicated by an arrow shown in FIG. 1. Housed body 18 is pressed into case 11 until ferrite core 13A in the head of housed body 18 contacts bottom surface 11C of case 11. After ferrite core 13A contacts bottom surface 11C of case 11, stopper 19 is inserted into case 11 to seal opening 11A of case 11 tightly.

When stopper 19 seals opening 11A tightly, first protrusion 17C forms first waterproof A at the side of opening 11A of case 11 and additionally second protrusion 17D forms second waterproof B at the side of lead wires 15. As described above, antenna device 20 of the present exemplary embodiment has first waterproof A and second waterproof B capable of preventing water immersion into case 11 from various portions.

First waterproof A and second waterproof B of stopper 19 is described next in detail with reference to FIGS. 3A and 3B.

In first waterproof A, substantially semicircular first protrusion 17C provided annularly on the outer periphery of packing 17 is formed to have a larger outside dimension D2 than inside dimension D1 of opening 11A of case 11.

In assembling first waterproof A, firstly annular projection 16C of lid 16 fits annular taper 17F formed on fitting section 17B of packing 17. Then the integration of lid 16 with packing 17, which is named as stopper 19, is inserted into case 11 from the side of opening 11A. At this time, first protrusion 17C contacts the inner periphery of case 11 resiliently. Lastly, hooks 16D provided on both top and bottom sides of lid 16 engage with locking holes 11B of case 11 to form first waterproof with a high reliability.

In second waterproof B, substantially semicircular second protrusion 17D provided annularly is formed to have a smaller inside dimension E2 than outside dimension E1 of lead wire 15. When lead wire 15 is inserted into through-hole 17A, second protrusion 17D contacts lead wire 15 resiliently, thus forming second waterproof B with a high reliability.

Moreover, first waterproof A and second waterproof B are disposed on locations approximately the same distance from the top surface of lid 16. Namely, at the locations apart from the top surface of lid 16 approximately distance L1, first protrusion 17C is provided on the outer periphery and second protrusion 17D on the inner periphery. Where, the top surface of lid 16 corresponds to the left hand side in FIG. 3A, and the top surface of lid 16 is the top surface of stopper 19 as well.

Therefore, a position where an external pressure from case 11 is applied on packing 17 and a position where an internal pressure from lead wire 15 is applied on packing 17 are approximately coplanarly. In a word, packing 17 is applied by the external pressure from case 11 and the internal pressure from lead wire 15 at approximately the same position in the case. Compared with the case when first waterproof A and second waterproof B are not disposed substantially coplanarly, the configuration of the present exemplary embodiment can provide an increased airtightness and a reliable waterproofing. To improve the waterproofing property, the dimension differences between D1 and D2, and E1 and E2 can be increased within the order of no influence at inserting.

The compression rates of first waterproof A and second waterproof B should preferably be ranging approximately 10 to 50% taking operability and waterproofing into consideration. Now, the compression rate is described in detail using first protrusion 17C of packing 17 shown in FIG. 3B as an example.

In the present exemplary embodiment, packing 17 has following dimensions taking top surface 16C0 of a base of annular projection 16C of lid 16 as a reference plane: base height H is 0.7 mm; initial height G of annular projection 16C of lid 16 before compression is 1.1 mm; and G value after compression is 0.8 mm. In this case the compression rate P is obtained by the following equation, $$P=(1.1-0.8)/1.1=0.28$$

According to the above calculation, first protrusion 17C is compressed approximately 30% in the present exemplary embodiment.

Additionally, projection 16E provided on lid 16 on the side of case 11 is inserted into recess 17E0 provided inside projection 17E of packing 17 as shown in FIG. 2A. Projection 17E of packing 17 contacts side surface 14B of terminal base 14 resiliently, thereby preventing antenna part 13 from rattling in case 11. In other words, antenna part 13 is fixed on a predetermined location in case 11 to prevent antenna part 13 from rattling in case 11 by using projection 17E provided on stopper 19.

Antenna device 20 with the above configuration is installed inside a vehicle door handle or the like. The in-vehicle unit installed in the vehicle decodes the signal waves received by antenna device 20 to control locking/unlocking the vehicle doors.

As described in the exemplary embodiment, stopper 19 is composed of lid 16 and packing 17, and provided with first water proof and second water proof. Having the two water proofes is very effective for preventing water from entering inside.

Projection 17E of packing 17 contacts antenna part 13 resiliently for positioning on a predetermined location to prevent antenna part 13 from rattling in case 11 and to improve strength against drop or vibration effectively.

First protrusion 17C and second protrusion 17D on packing 17 are described to form first waterproof A and second waterproof B respectively in the present exemplary embodiment, but the present invention is not limited to this only.

Figure 4:
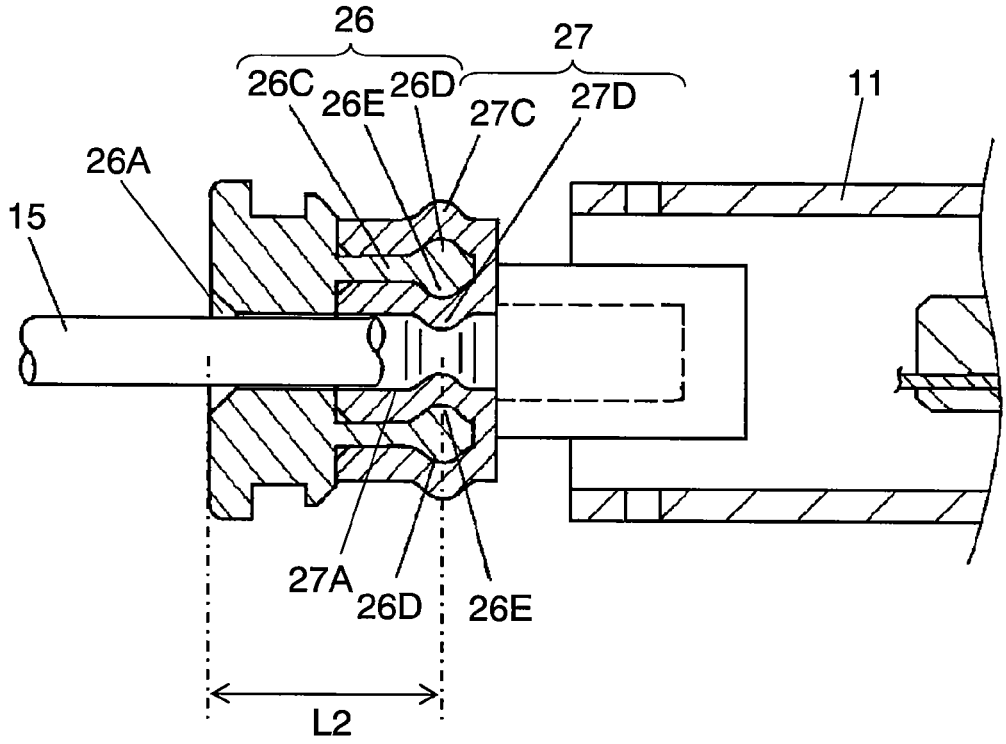
FIG. 4 shows an enlarged cross-sectional view of an essential part of another antenna device used in the exemplary embodiment of the present invention.

Annular projection 26C of lid 26 may be provided with protrusion 26D provided on the outer periphery side in the head and with protrusion 26E on the inner periphery in the head as shown in FIG. 4. These protrusions 26D and 26E form third protrusion 27C and fourth protrusion 27D on packing 27. Third protrusion 27C and fourth protrusion 27D thus formed will perform as first waterproof A and second waterproof B respectively.

Third protrusion 27C and fourth protrusion 27D, in the example in FIG. 4, are both located at a distance L2 from the top surface of lid 26. Lead wires 15 extend outward through through-holes 27A of packing 27 and through-holes 26A provided on lid 26. Third protrusion 27C provided on the outer periphery contacts case 11 resiliently to form first waterproof A, and fourth protrusion 27D contacts lead wire 15 to form second waterproof B.

Lid 16 and packing 17 are described to be integrated from originally separated parts but can be molded integrally from the beginning. One of the examples is shown in FIG. 5.

Figure 5:
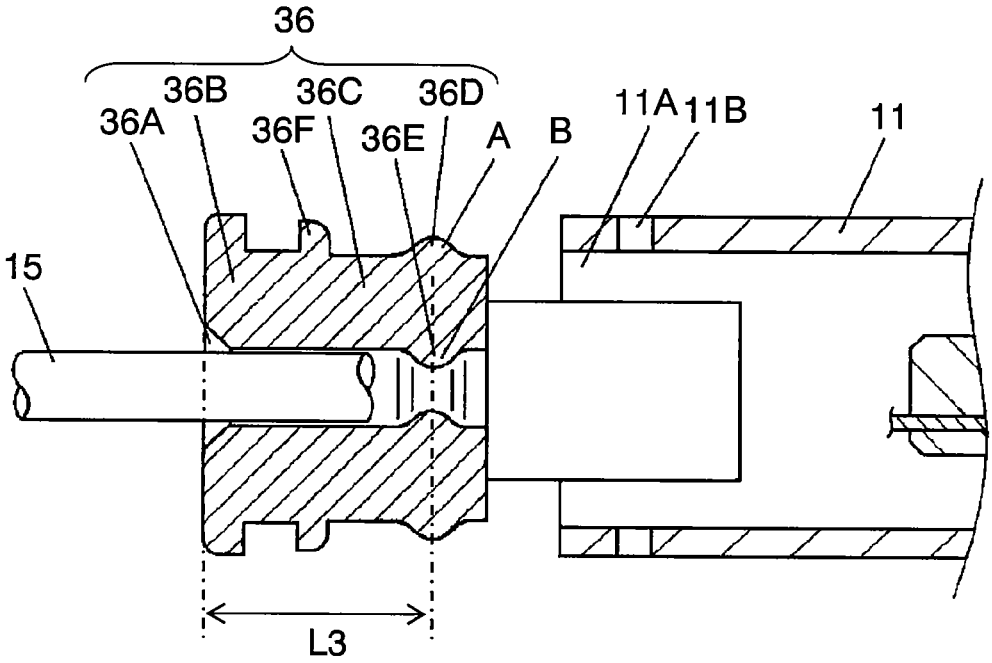
FIG. 5 shows an enlarged cross-sectional view of an essential part of still another antenna device used in the exemplary embodiment of the present invention.
Figure 6:
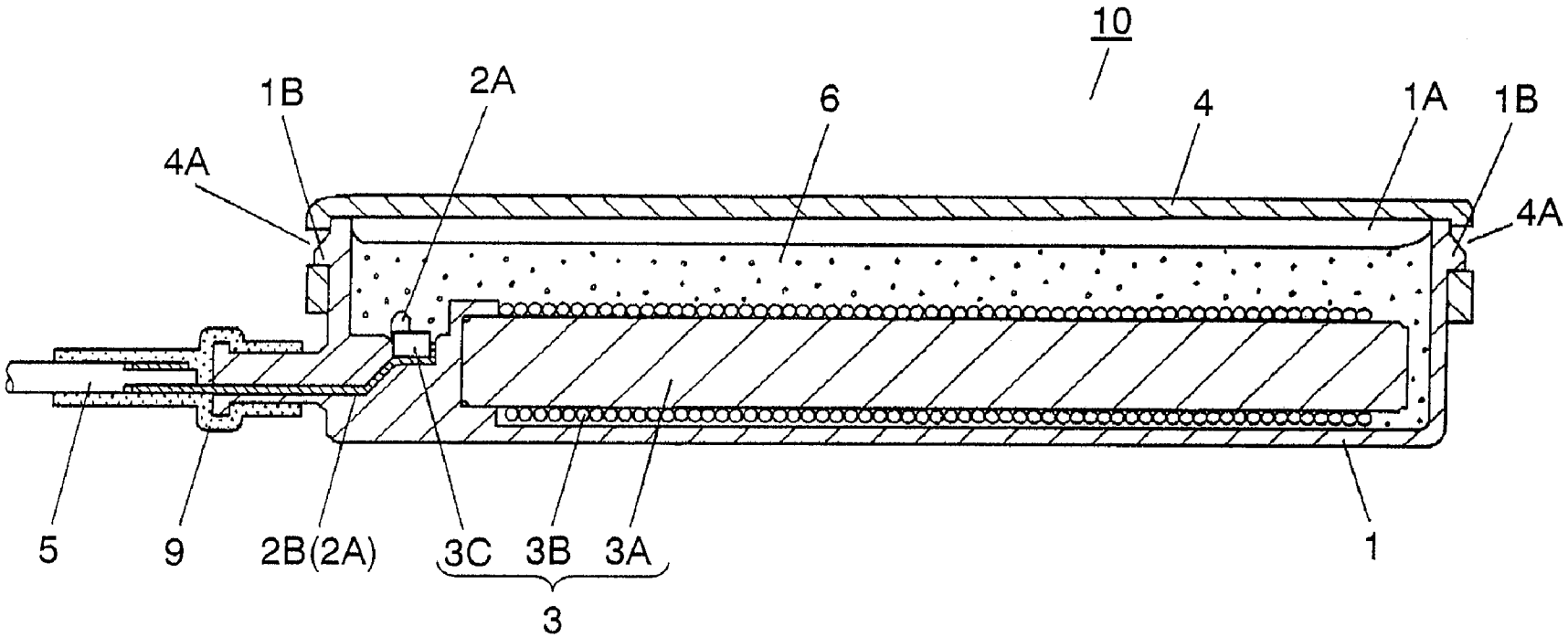
FIG. 6 PRIOR ART
FIG. 6 shows a cross-sectional view of a conventional antenna device.

In an example shown in FIG. 5, lid itself forms stopper 36. Stopper 36 is formed from elastic materials such as elastomer or the like. Stopper 36 has annular projection 36C substantially perpendicular to base 36B in the right direction. Substantially semicircular fifth protrusion 36D is provided annularly on the outer periphery of annular projection 36C and substantially semicircular sixth protrusion 36E provided on the inner periphery of annular projection 36C. Fifth protrusion 36D forms first waterproof A and sixth protrusion 36E forms second waterproof B. Fifth protrusion 36D and sixth protrusion 36E are both located at a distance L3 from the top surface of lid 36 in the example shown in FIG. 5. Lead wires 15 extend outward through through-holes 36A provided on stopper 36. Fifth protrusion 36D provided on the outer periphery contacts case 11 resiliently to form first waterproof A and sixth protrusion 36E on the inner periphery contacts lead wires 15 resiliently to form second waterproof B.

As described above, stopper 36 formed from a single material can be effective for cheaper production cost due to decrease in parts number as well as increase in airtightness.

The portions contacting inner periphery of case 11 resiliently such as first protrusion 17C, third protrusion 26D and fifth protrusion 36D are generically named as outer peripheral protrusions, and the portions contacting lead wires 15 resiliently such as second protrusion 17D, fourth protrusion 26E and sixth protrusion 36E are generically named as inner peripheral projections.

Moreover, the portions of packing 17 to form first waterproof A and second waterproof B such as first protrusion 17C, second protrusion 17D or the like are to be substantially semicircular protrusions in the above description. However, the shape of first protrusion 17C, second protrusion 17D or the like is not limited to substantially semicircular protrusion. The protrusion can be such a shape as substantially triangle, substantially trapezoid or the like.

The antenna device disclosed in the present invention can prevent water immersion into the antenna part without using any filler required previously and has an effect of easy productivity as well, and is very useful for use in the remote-control system to control locking/unlocking the vehicle doors in a distance.

It will be obvious to those skilled in the art that various changes may be made in the above-described embodiment of the present invention. However, the scope on the present invention should be determined by the following claims.

What is claimed is:

1. An antenna device comprising:

a cylindrical shaped case with an opening;

an antenna part housed in the case;

lead wires connected to the antenna part electrically and extending outward from the case through the opening;

a stopper to seal the opening of the case tightly;

a first waterproof provided on the outer periphery of the stopper; and a second waterproof provided on the inner periphery of the stopper.

2. The antenna device of claim 1, wherein the first waterproof and the second waterproof are located at a same distance from a top surface of the stopper and are located inside the case.

3. The antenna device of claim 1, wherein:

the stopper comprises a lid to seal the opening and a packing disposed next to the lid to contact inner periphery of the case tightly;

the packing comprises an outer periphery to contact the case and an inner periphery to contact the lead wires;

the first waterproof comprises an outer peripheral protrusion provided on the outer periphery of the packing entirely to contact the case resiliently and the second waterproof comprises an inner peripheral protrusion provided on the inner periphery of the packing entirely to contact the lead wire resiliently.

4. The antenna device of claim 3, wherein the outer peripheral protrusion and the inner peripheral protrusion are located at a same distance from the top surface of the lid.

5. The antenna device of claim 1, wherein:

the stopper is formed from elastic materials;

the stopper comprises an outer periphery to contact the case and an inner periphery to contact the lead wire;

the first waterproof comprises an outer peripheral protrusion provided on the outer periphery of the stopper entirely to contact the inner periphery of the case resiliently and the second waterproof comprises an inner peripheral protrusion provided on the inner periphery of the stopper entirely to contact the lead wire resiliently.

6. The antenna device of claim 5, wherein the outer peripheral protrusion and the inner peripheral protrusion are located at a same distance from a top surface of the stopper.

7. The antenna device of claim 1, wherein the stopper further comprises a projection extending inward the case and the projection contacts the antenna part resiliently for positioning the antenna part.

* * * * *

UNITED STATES PATENT AND TRADEMARK OFFICE

CERTIFICATE OF CORRECTION

PATENT NO. : 7,400,305 B2
APPLICATION NO. : 11/612086
DATED : July 15, 2008
INVENTOR(S) : Hideki Shigemoto It is certified that error appears in the above-identified patent and that said Letters Patent is hereby corrected as shown below:

Title page item 75
"Hideki Shigemoto, Okaka" should read --Hideki Shigemoto, Osaka--

Signed and Sealed this

Twenty-fifth Day of November, 2008

JON W. DUDAS
*Director of the United States Patent and Trademark Office*